US005929833A

United States Patent [19]

Koshobu et al.

[11] Patent Number: 5,929,833

[45] Date of Patent: Jul. 27, 1999

[54] MATRIX LIQUID CRYSTAL DISPLAY HAVING TEMPERATURE-DEPENDENT ELEMENT DRIVE TIMING AND METHOD OF DRIVING THE SAME

[75] Inventors: Nobuaki Koshobu, Kariya; Masao Tokunaga, Gamagoori, both of Japan

[73] Assignee: Nippondenso Co., Ltd., Kariya, Japan

[21] Appl. No.: 08/709,822

[22] Filed: Sep. 10, 1996

[30] Foreign Application Priority Data

Sep. 11, 1995 [JP] Japan ..... 7-232876

[51] Int. Cl.[6] ..... G09G 03/36

[52] U.S. Cl. ..... 345/101; 345/94; 345/97

[58] Field of Search ..... 345/97, 101, 94, 345/95, 96, 92, 93, 88, 89, 208, 209, 210; 349/174, 100, 37, 34, 74, 77, 96, 97, 87, 72

[56] References Cited

U.S. PATENT DOCUMENTS

| | | | |
|---|---|---|---|
| 4,745,403 | 5/1988 | Tamura | 345/101 |
| 4,917,469 | 4/1990 | Ross | 349/34 |
| 5,011,269 | 4/1991 | Wakita et al. | 345/89 |
| 5,459,481 | 10/1995 | Tanaka et al. | 345/95 |

FOREIGN PATENT DOCUMENTS

| | | |
|---|---|---|
| 558-060 | 9/1993 | European Pat. Off. . |
| 4-249290 | 9/1992 | Japan . |
| 4-311291 | 11/1992 | Japan . |
| 4-311920 | 11/1992 | Japan . |
| 5-210092 | 8/1993 | Japan . |
| 5-273941 | 10/1993 | Japan . |
| 5-307169 | 11/1993 | Japan . |
| 6-082760 | 3/1994 | Japan . |

OTHER PUBLICATIONS

Optronics (1994) No. 2 pp. 58–61.

*Primary Examiner*—Richard A. Hjerpe
*Assistant Examiner*—Francis N. Nguyen
*Attorney, Agent, or Firm*—Pillsbury Madison & Sutro LLP

[57] ABSTRACT

A matrix liquid crystal display using an antiferroelectric liquid crystal prevents the displayed image from tailing off. The liquid crystal display includes a liquid crystal panel, a temperature sensor, a control unit, a scanning electrode driver circuit, and a signal electrode driver circuit. When the temperature of the liquid crystal panel is detected by the temperature sensor, the control unit increases or reduces the de-select period according to the detected temperature. The scanning electrode driver circuit and the signal electrode driver circuit serve to drive scanning electrodes and signal electrodes, respectively included in the liquid crystal panel according to control signals from the control unit and from a level converter. These control signals include a signal indicating the controlled de-select period. Thus, the controlled de-selected period is secured.

19 Claims, 8 Drawing Sheets

Vwp
Vhp
Y1 Ve
Vhn
Vwn

Vwp
Vhp
Y2 Ve
Vhn
Vwn

Vwp
Vhp
Y3 Ve
Vhn
Vwn
Y1 -M E +S +M E -S -M
Y2 +M E -S -M E +S +M
Y3 -M E +S +M E -S -M

Vsp
Xi Ve
Vsn
BRIGHT (%) 100 75 50 0 100 75 50 0

Vwp
Vhp
Y1 Ve
Vhn
Vwn

Vwp
Vhp
Y2 Ve
Vhn
Vwn

Vwp
Vhp
Y3 Ve
Vhn
Vwn
Y1 -M E +S +M E -S -M
Y2 +M E -S -M E +S +M
Y3 -M E +S +M E -S -M

SCC

S101

S102

DP

Vsp
Xi Ve
Vsn
DISD. DATA
L1 NL1
L2 NL2
L3 NL3
L4 NL4
L5 NL5
FIG. 8B SHS
FIG. 8C DP
FIG. 8D STD
FIG. 8E OE

L1
OUT
L3
L5

NL1
NL3
NL5

L2
L4
L6

NL2
NL4
NL6
FIG. 8J STD
FIG. 8K HCK1
FIG. 8L HCK2
FIG. 8M HCK3
SAMP. TIMING
X1
X2
X3
X4
X5
X6
Xm-3
Xm-2
Xm-1
Xm

MATRIX LIQUID CRYSTAL DISPLAY HAVING TEMPERATURE-DEPENDENT ELEMENT DRIVE TIMING AND METHOD OF DRIVING THE SAME

CROSS-REFERENCE TO RELATED APPLICATION

The present application is related to and claims priority from Japanese Patent Application No. Hei. 7-232876, incorporated herein by reference.

BACKGROUND OF THE INVENTION

1. Field of the Invention

The present invention relates to a matrix liquid crystal display using an antiferroelectric liquid crystal to provide a matrix-driven display and to a method of driving such a display.

2. Description of Related Art

A known matrix liquid crystal display of this kind is described, for examples in *OPTRONICS,* No. 2, pp. 58–61 (1994). In this devices a de-select period in which pixels are deactivated, a select period in which only pixels necessary to display an image are activated, and a retention period in which the displayed state is maintained are successively repeated. Scanning electrodes on successive lines are driven such that the lines are sequentially scanned. In this way, a desired image is displayed.

In this driving method, if the contents of the display created by selected pixels are not completely erased during the de-select period, the image is not momentarily switched from a bright state to a dark state. Therefore, if a dark object moves on a bright background, the object is accompanied by a white tail. That is, the displayed image tails off.

In order to prevent this undesirable phenomenon, it is necessary to establish sufficiently long de-select periods. Furthermore, the response time between the instant when a positive or negative ferroelectric state providing a bright display is established and the instant when an antiferroelectric state providing a dark display is established varies with the operating temperature. In this case, the de-select period is increased as the temperature becomes lower. Accordingly, in order to prevent the displayed image from tailing off over a wide range of temperatures, it is necessary to establish the de-select period in such a way that the contents of the displayed image can be fully erased even at the lowest temperature.

However, if this scheme is adopted, the de-select period is too long at normal operating temperatures, and the retention period is too short. As a result, the brightness of the image in a dark state drops.

SUMMARY OF THE INVENTION

The inventors have studied the relationship between the response time to the operating temperature, the response time being measured from the instant when pixels of an antiferroelectric liquid crystal are activated and the instant when the pixels are deactivated. As a result, a characteristic curve L as shown in FIG. 9 has been obtained. It can be seen that the response time rapidly decreases as the temperature is elevated from 0° C. to 20° C. The response time slowly decreases as the temperature is elevated from 20° C. to 60° C. In other words within the range of from 0° C. to 20° C., the response time is prolonged rapidly as the operating temperature lowers. In step with this, the de-select period is required to be increased rapidly as the operating temperature lowers. Within the range of from 20° C. to 60° C., the response time gradually increases as the operating temperature lowers. In step with this, the de-select period is required to be slowly increased.

Accordingly, the inventors have discovered that if an optimum relation is established between the response time of the antiferroelectric liquid crystal and the operating temperature by making effective use of the above-described features so as to prevent the aforementioned tailing of the displayed image over a wide range of temperatures, then the above-described problems can be eliminated. Consequently, the contents of an image created by pixels can be fully erased over a wide range of temperatures. Hence, the tailing described above can be prevented.

If the de-select period is so set that it is maximal for every operating temperature, then the de-select period is excessively long. This prevents the retention time from becoming insufficient. Hence, the brightness of the displayed image can be prevented from decreasing.

Accordingly, it is an object of the present invention to provide a matrix liquid crystal display which uses an antiferroelectric liquid crystal and is capable of appropriately preventing the displayed image from tailing off.

This object is achieved according to an aspect of the present invention by providing a matrix liquid crystal display which includes a liquid crystal panel, a temperature sensor, a control unit, a scanning electrode driver circuit, and a signal electrode driver circuit. When the temperature of the liquid crystal panel is detected by the temperature sensor, the control unit increases or reduces the de-select period according to the detected temperature The scanning electrode driver circuit and the signal electrode driver circuit serve to drive scanning electrodes and signal electrodes, respectively, included in the liquid crystal panel according to control signals from the control unit and from a level converter These control signals include a signal indicating the controlled de-select period. Thus, the controlled de-selected period is secured.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 8A–8M are graphs illustrating the operation of the signal electrode driver circuit shown in FIG. 2.

DETAILED DESCRIPTION OF THE PRESENTLY PREFERRED EXEMPLARY EMBODIMENTS

Figure 1:
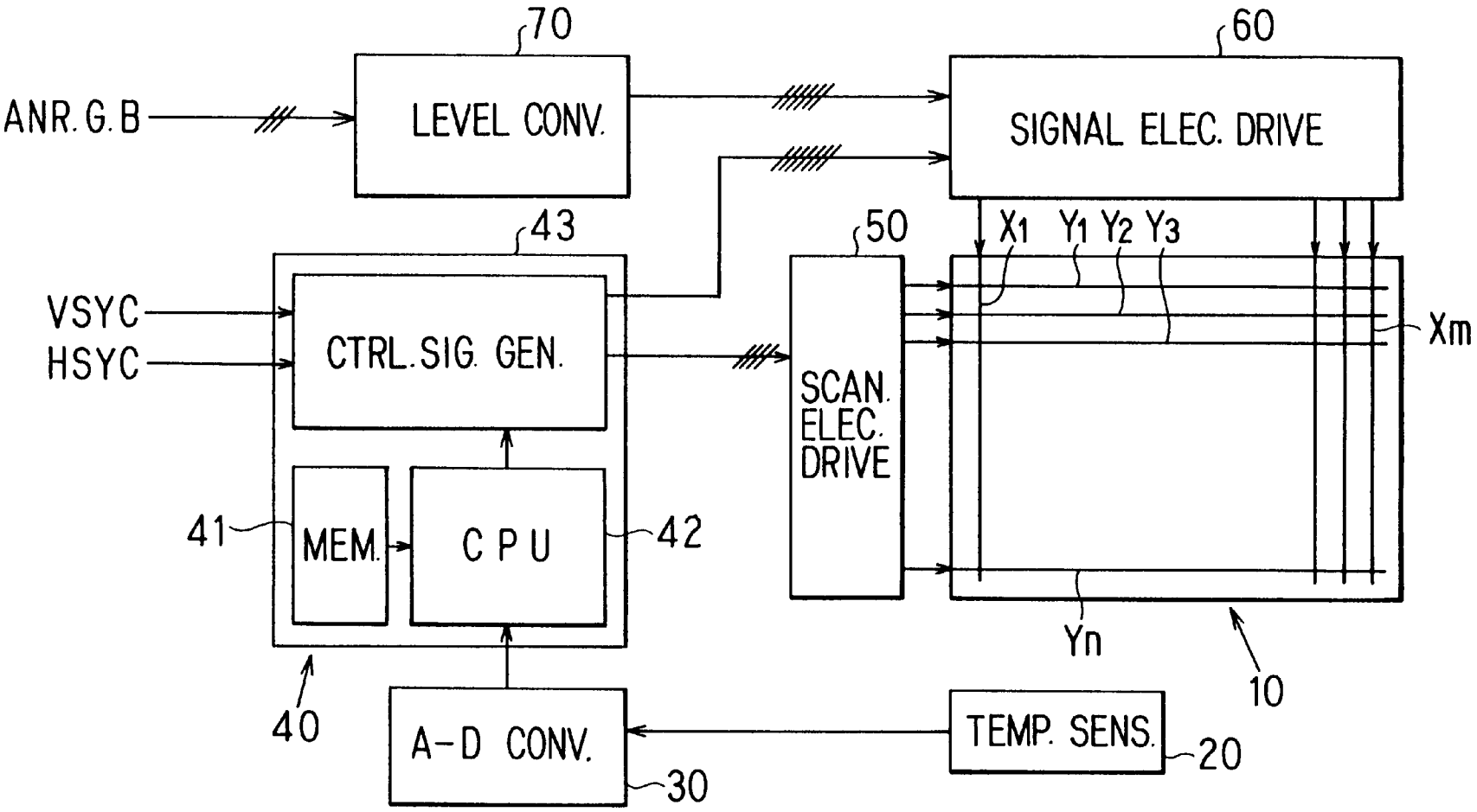
FIG. 1 is a schematic block diagram of a liquid crystal display according to the present invention.

Referring to FIG. 1, the entire construction of a matrix liquid crystal display according to the present invention is schematically shown. This matrix liquid crystal display has a liquid crystal panel 10 which includes n scanning electrodes $Y_1$–$Y_n$ arrayed horizontally and m signal electrodes $X_1$–$X_m$ arrayed vertically. The signal electrodes $X_1$–$X_m$ oppose the scanning electrodes $Y_1$–$Y_n$ via an antiferroelectric liquid crystal layer. These n scanning electrodes $Y_1$–$Y_n$, m signal electrodes $X_1$–$X_m$, and antiferroelectric liquid crystal layer together form a matrix construction consisting of n×m pixels.

The liquid crystal display is equipped with a temperature sensor 20 which detects the temperature of the liquid crystal panel 10. An analog-to-digital converter (A/D converter) 30 converts the analog output signal from the temperature sensor 20 into digital form The digital output from the converter 30 is fed to a control unit 40.

This control unit 40 has a memory 41 in which data about the relations among operating temperatures of the antiferroelectric liquid crystal, optimum response times, and optimum de-select periods as listed in the following TABLE 1 has been previously stored.

Figure 9:
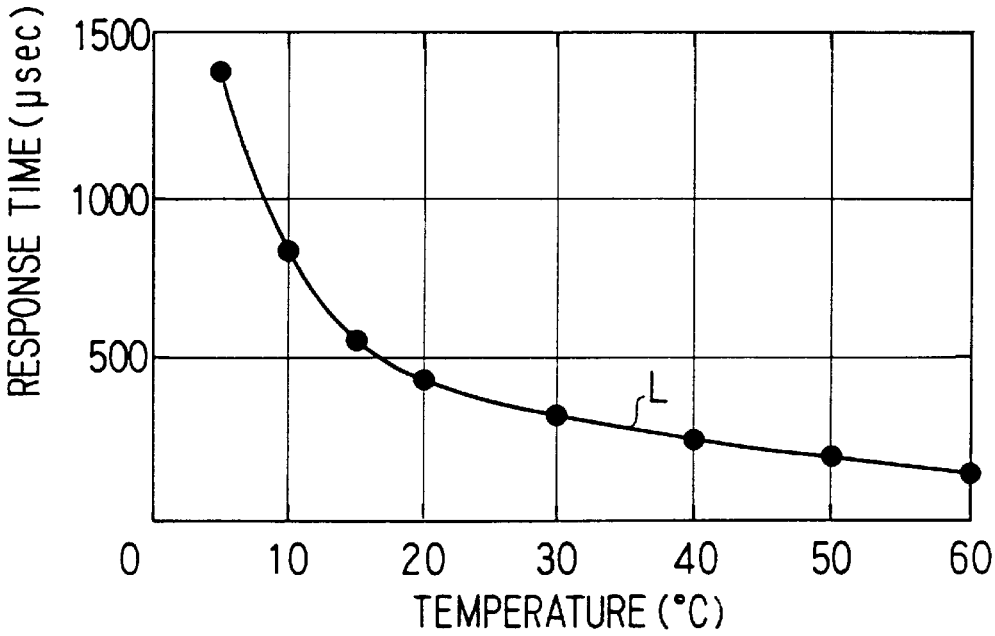
FIG. 9 is a graph illustrating the dependence of bright-dark state transition of an antiferroelectric liquid crystal on temperature, the antiferroelectric liquid crystal being used in the liquid crystal display shown in FIG. 1.
Figures 6A, 6B, 6C, 6D:
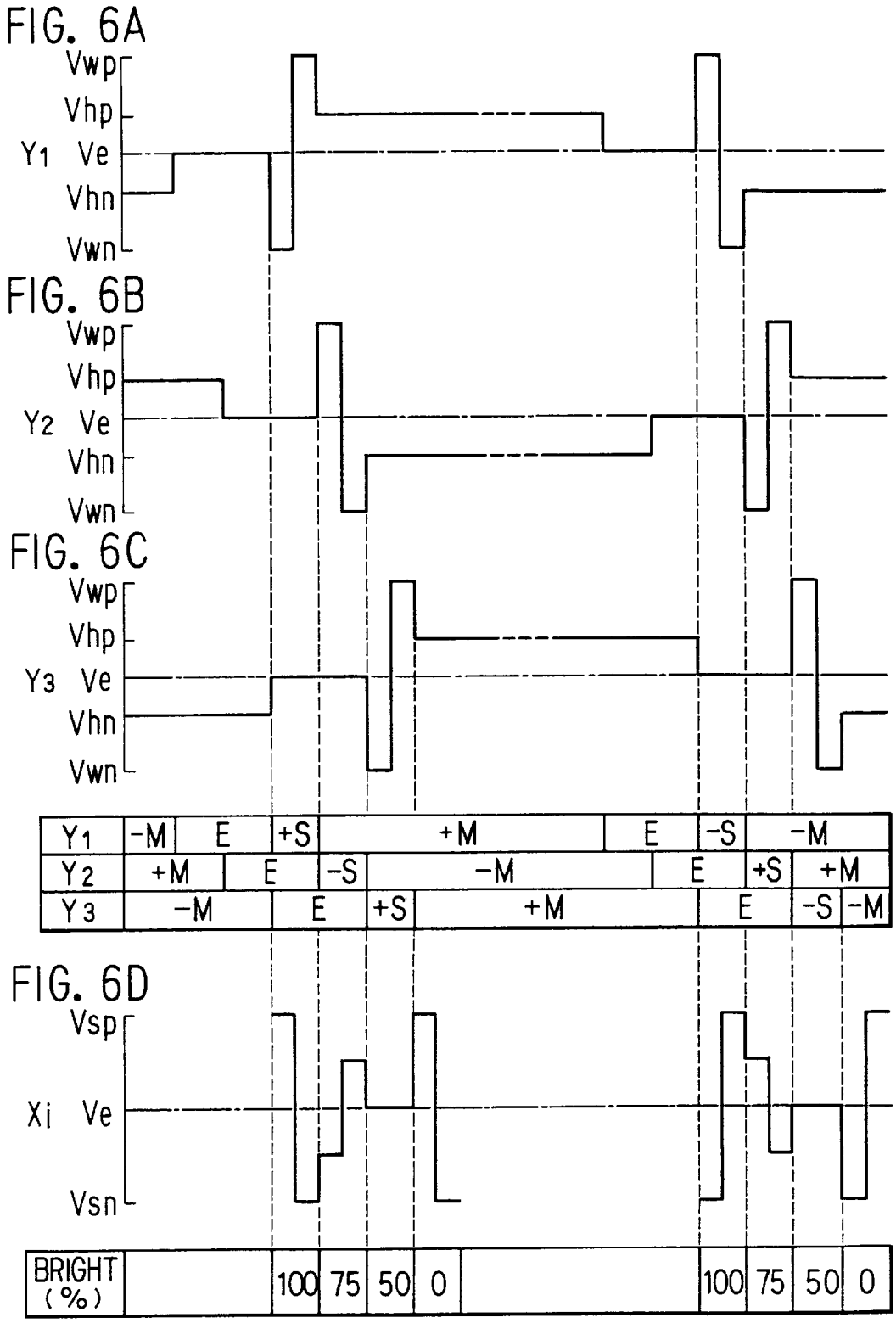
FIGS. 6A–6D are graphs showing the waveforms of signals for driving various electrodes included in the liquid crystal display shown in FIG. 1.

The data in TABLE 1 above represents the relations among operating temperatures of the antiferroelectric liquid crystal, optimum response times, and optimum de-select periods. The relations have been determined, by making active use of the characteristic curve L of FIG. 9 to prevent the displayed image from tailing off over a wide range of operating temperatures. The symbol H used in TABLE 1 indicates the writing time of 63.5 μsec corresponding to the period of an SCC (scan clock) signals

TABLE I

| operating temperature (° C.) | optimum response time (μsec) | optimum de-select period (nH) |
|---|---|---|
| 5 | 1381 | 22 H |
| 10 | 836 | 14 H |
| 15 | 553 | 9 H |
| 20 | 429 | 7 H |
| 30 | 324 | 6 H |
| 40 | 260 | 5 H |
| 50 | 196 | 4 H |
| 60 | 144 | 3 H |

and n is a natural number. As will be apparent to those skilled in the art, the SCC signal is a scan clock signal providing basic timing signals to the display unit.

The control unit 40 incorporates a CPU 42, which calculates the optimum response time, in other words, the optimum de-select period, from the data stored in the memory 41 and from the digital temperature indicated by the output signal from the A/D converter 30. Data about this optimum de-select period is sent to a control signal-generating circuit 43.

A vertical synchronizing signal VSYC and a horizontal synchronizing signal HSYC are applied externally to the control signal-generating circuit 43. The control signal-generating circuit 43 creates a scanning electrode driver circuit control signal and a signal electrode driver circuit control signal from the incoming synchronizing signals VSYC and HSYC and from the output signal from the CPU 42 indicating the optimum de-select period. The scanning electrode driver circuit control signal and signal electrode driver circuit control signal are fed to a scanning electrode driver circuit 50 and a signal electrode driver circuit 60, respectively.

Figure 2:
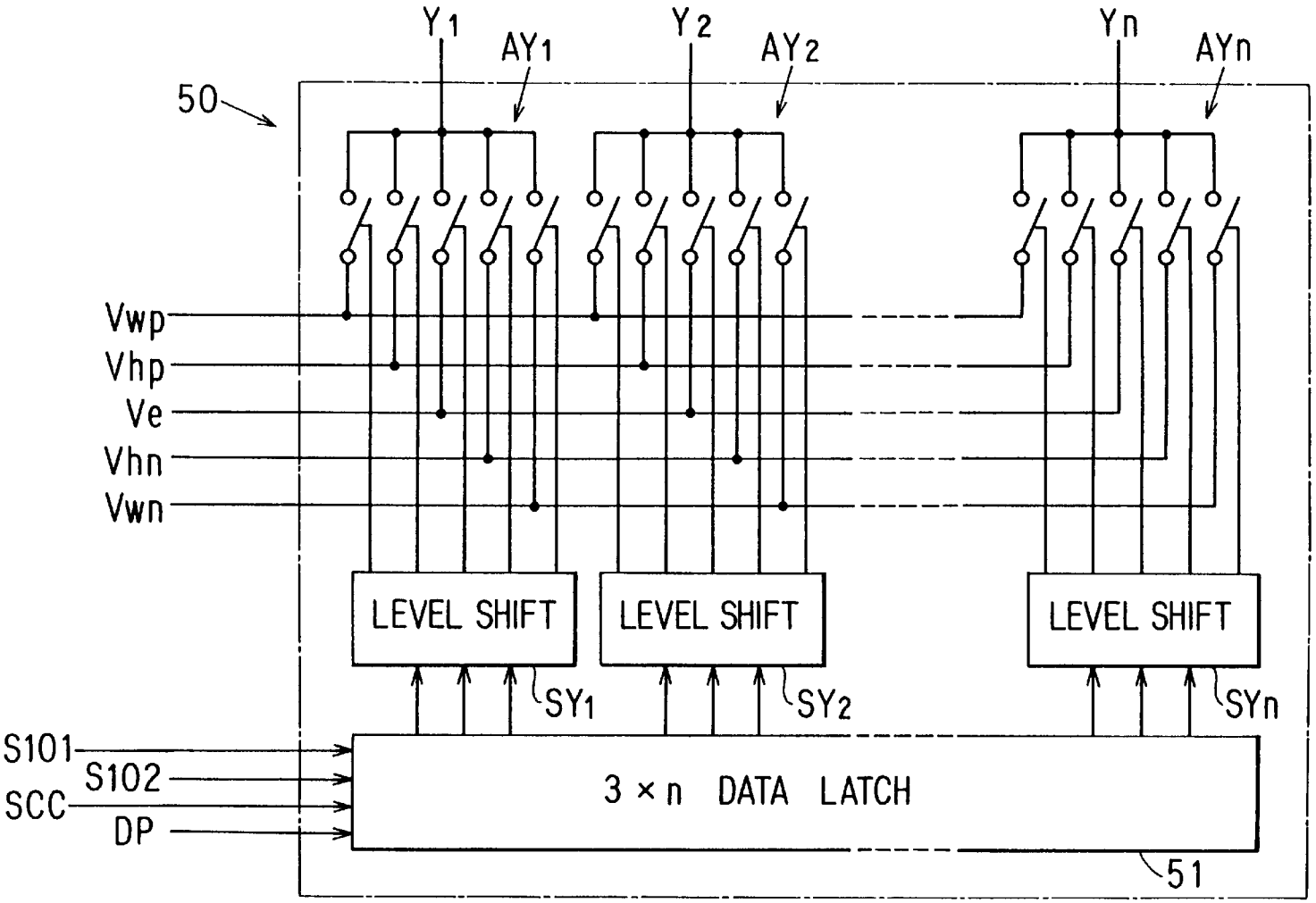
FIG. 2 is a circuit diagram of a scanning electrode driver circuit included in the liquid crystal display shown in FIG. 1.

As shown in FIG. 1, the scanning electrode driver circuit 50 is connected between the control unit 40 and the scanning electrodes $Y_1$–$Y_n$ of the liquid crystal panel 10. As shown in FIG. 2, this scanning electrode driver circuit 50 includes a data latch 51 of 3×n bits, n level shifters $SY_1$–$SY_n$ connected to the data latch 51, and n analog switch sets $AY_1$–$AY_n$ connected to the level shifters $SY_1$–$SY_n$, respectively. Each of the analog switch sets $AY_1$–$AY_n$ consists of five analog switches. An SIO1 signals an SIO2 signal, the aforementioned SCC signal, and a DP signal are applied to the data latch 51.

Figures 7A, 7B, 7C, 7D, 7E, 7F, 7G:
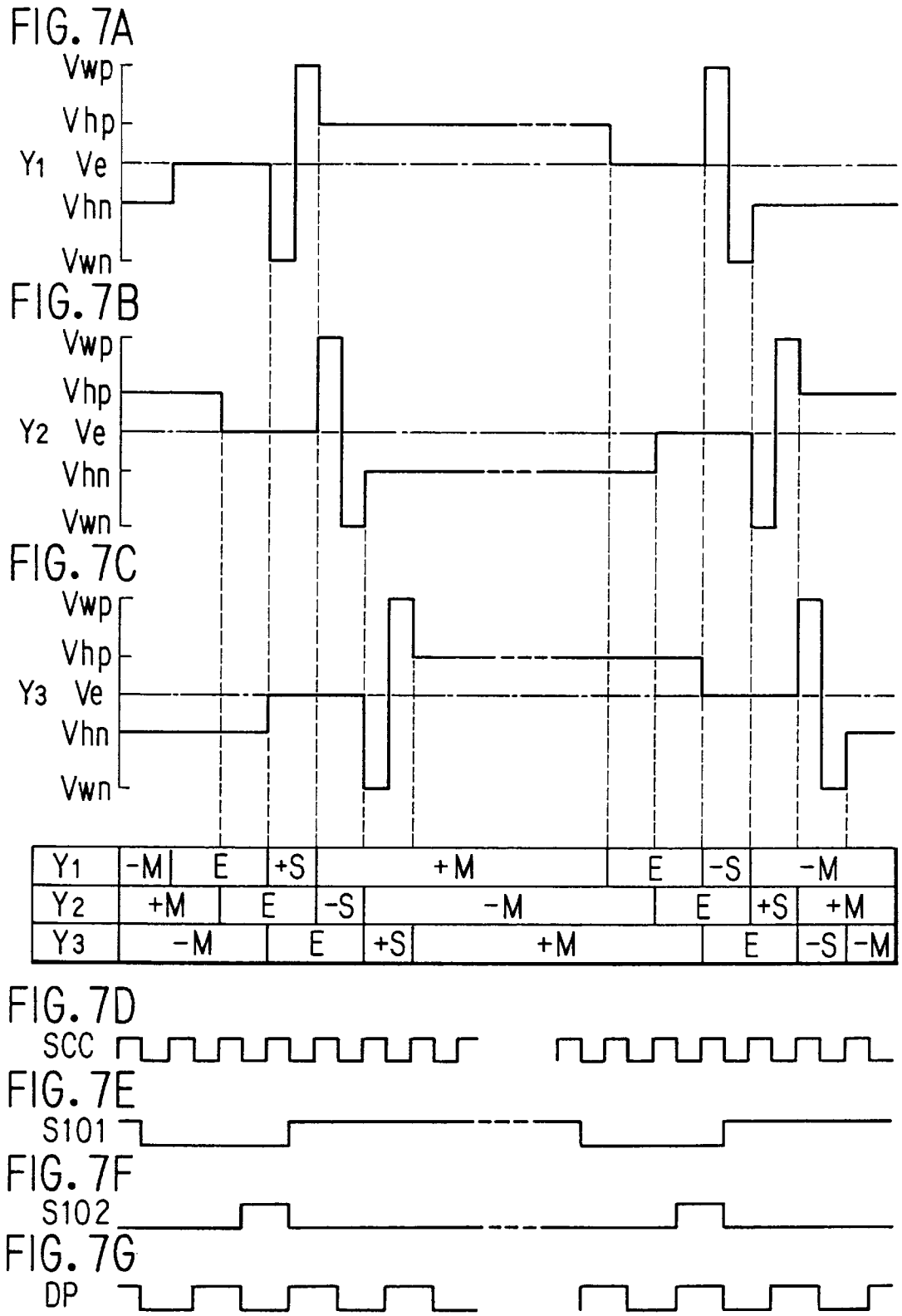
FIGS. 7A–7G are graphs illustrating the operation of the scanning electrode driver circuit shown in FIG. 2.

This scanning electrode driver circuit 50 successively applies voltages indicating de-select states select state, and retention state, to the scanning electrodes $Y_1$–$Y_n$, as shown in FIGS. 7A–7C (it should be noted that in FIGS. 7A–7G as well as other similar drawings, the notations "−M" and "+M" in the lines for Y1–Y3 denote negative and positive maintain voltage respectively; "−S" and "+S" denote negative and positive select voltages, respectively, and "E" denotes an erase voltage). In order to AC-drive the scanning electrode driver circuit 50, the polarity of the voltage is switched between a positive value and a negative value whenever a select period starts. These signals SIO1, SIO2, SCC and DP shown in FIGS. 7D–7G correspond to scanning electrode driver circuit control signals from the above-described control signal-generating circuit.

The SIO1 and SIO2 signals determine the states of the scanning electrodes $Y_1$–$Y_n$. In the present embodiment, when both SIO1 and SIO2 signals are at a low level, the de-select state is established. When the SIO1 signal is at a low level and the SIO2 signal is at a high level, the select state is established. Conversely when the SIO1 signal is at a high level and the SIO2 signal is at a low level, the retention state is established. In order to control the states of the scanning electrodes $Y_1$–$Y_n$, the SIO1 and SIO2 signals are accepted into the data latch 51 on each leading edge of the SCC signal.

The DP signal determines the polarity of the voltage. When the scanning electrodes $Y_1$–$Y_n$ are selected during a positive select period, for example, the DP signal is switched from a low level to a high level, and the output voltage is switched from Vwn to Vwp. In this way, data about the applied DP signal directly determines the polarity of the select voltage. When a retention period starts, the polarity maintains the state established by the DP signal applied during the immediately preceding select period. Therefore, the polarity does not depend on the DP signal.

The operation of the scanning electrode driver circuit 50 is next described by referring to FIGS. 2–7G, taking the scanning electrode $Y_1$ as an example. During a de-select period, a de-select voltage Ve is produced to the scanning electrode $Y_1$ via the analog switch set $AY_1$. Therefore, every pixel on the scanning electrode $Y_1$ is deactivated. During a positive select period, the negative writing voltage Vwn is once produced to the scanning electrode $Y_1$ via the analog switch set $AY_1$. Then, the positive writing voltage Vwp is produced to the scanning electrode $Y_1$ via the analog switch set $AY_1$.

During a positive retention period, the retention voltage Vhp is delivered to the scanning electrode $Y_1$ via the analog switch set $AY_1$. Consequently, the contents of the display on the liquid crystal panel 1 are maintained until the next de-select period.

After the next de-select period, the pixels are activated with alternating current. For this purpose, a negative select period of polarity opposite to the previous select period is established. The positive writing voltage Vwp is once produced to the scanning electrode $Y_1$ via the analog switch set $AY_1$. Then, the negative writing voltage Vwn is delivered to the scanning electrode $Y_1$ via the analog switch set $AY_1$.

During a negative retention period, a retention voltage Vhn is delivered to the scanning electrode $Y_1$ via the analog switch set $AY_1$. Consequently, the contents of the display on the liquid crystal panel 1 are maintained until the next de-select period. Subsequently, these operations are repeated.

In the scanning electrode driver circuit 50, the scanning electrodes $Y_1$–$Y_n$ are scanned successively in this order and so a writing voltage whose waveform is shifted according to the duration of the select period is applied to each scanning electrode following the scanning electrode $Y_1$ such as the electrode $Y_2$ via the corresponding analog switch set. At this time, in order to prevent the image displayed on the liquid crystal panel 1 from flickering, the polarity of the voltage is made different between successive scanning electrodes. For instance, a positive voltage is applied to the scanning electrode $Y_1$, a negative voltage is applied to the electrode $Y_2$, a positive voltage is applied to the electrode $Y_3$, and so on.

As can be seen from the description provided thus far, the scanning electrode driver circuit 50 accepts the 3-bit data consisting of the SIO1, SIO2, and DP signals by means of the data latch 51 on each leading edge of the SCC signal. Data about the output signals for the scanning electrodes $Y_1$–$Y_n$ are sent via the level shifters $SY_1$–$SY_n$, respectively, to the analog switch sets $AY_1$–$AY_n$, respectively, whereby the five analog switches of each set are controlled. In this way, waveforms for driving the scanning electrodes are created, as shown in FIGS. 6A–6D.

Figure 3:
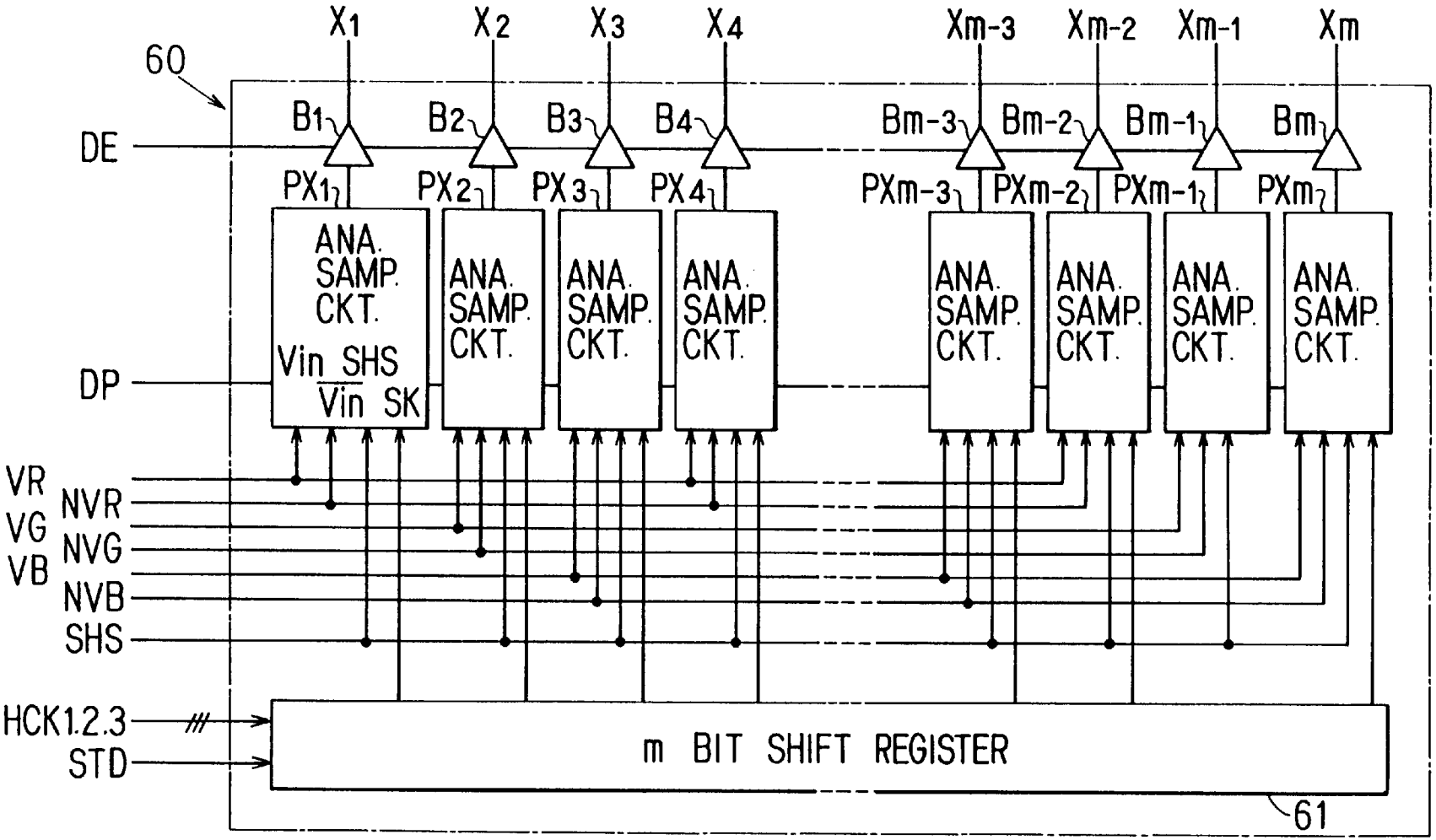
FIG. 3 is a circuit diagram of a signal electrode driver circuit included in the liquid crystal display shown in FIG. 1.

The signal electrode driver circuit 60 is connected among the control signal-generating circuit 43, the signal electrodes $X_1$–$X_n$ of the liquid crystal panel 10, and a level converter circuit 70, as shown in FIG. 1. As shown in FIG. 3, this signal electrode driver circuit 60 includes an m-bit shift register 61, m analog sampling circuits $Px_1$–$Px_m$, and m output buffers $B_1$–$B_m$ connected to the analog sampling circuits $Px_1$–$Px_m$, respectively. An HCK1 signal, an HCK2 signal, an HCK3 signal, and an STD signal are applied to the shift register 61. The timing at which the analog sampling circuits $Px_1$–$Px_m$ sample their input signals are controlled by the shift register 61.

The m-bit shift register 61 receives the STD signal HCK1 signal, HCK2 signal and HCK3 signal from the control signal-generating circuit 43. These signals STD, HCK1 HCK2 and HCK3 constitute parts of the above-described signal electrode driver circuit control signals. The STD signal gives the timing at which an image signal voltage is applied for each scanning line. The HCK1 signal gives the timing at which image signal voltages to signal electrodes $X_1, X_4, X_7, \ldots, X_{m-2}$ are sampled. The HCK2 signal gives the timing at which image signal voltages to signal electrodes $X_2, X_5, X_8, \ldots, X_{m-1}$ are sampled. The HCK3 signal gives the timing at which image signal voltages to signal electrodes $X_3, X_6, X_9, \ldots, X_m$ are sampled. The aforementioned image signal voltages are produced by the level converter circuit 70 as described later.

Figures 8A, 8F, 8G, 8H, 8I:
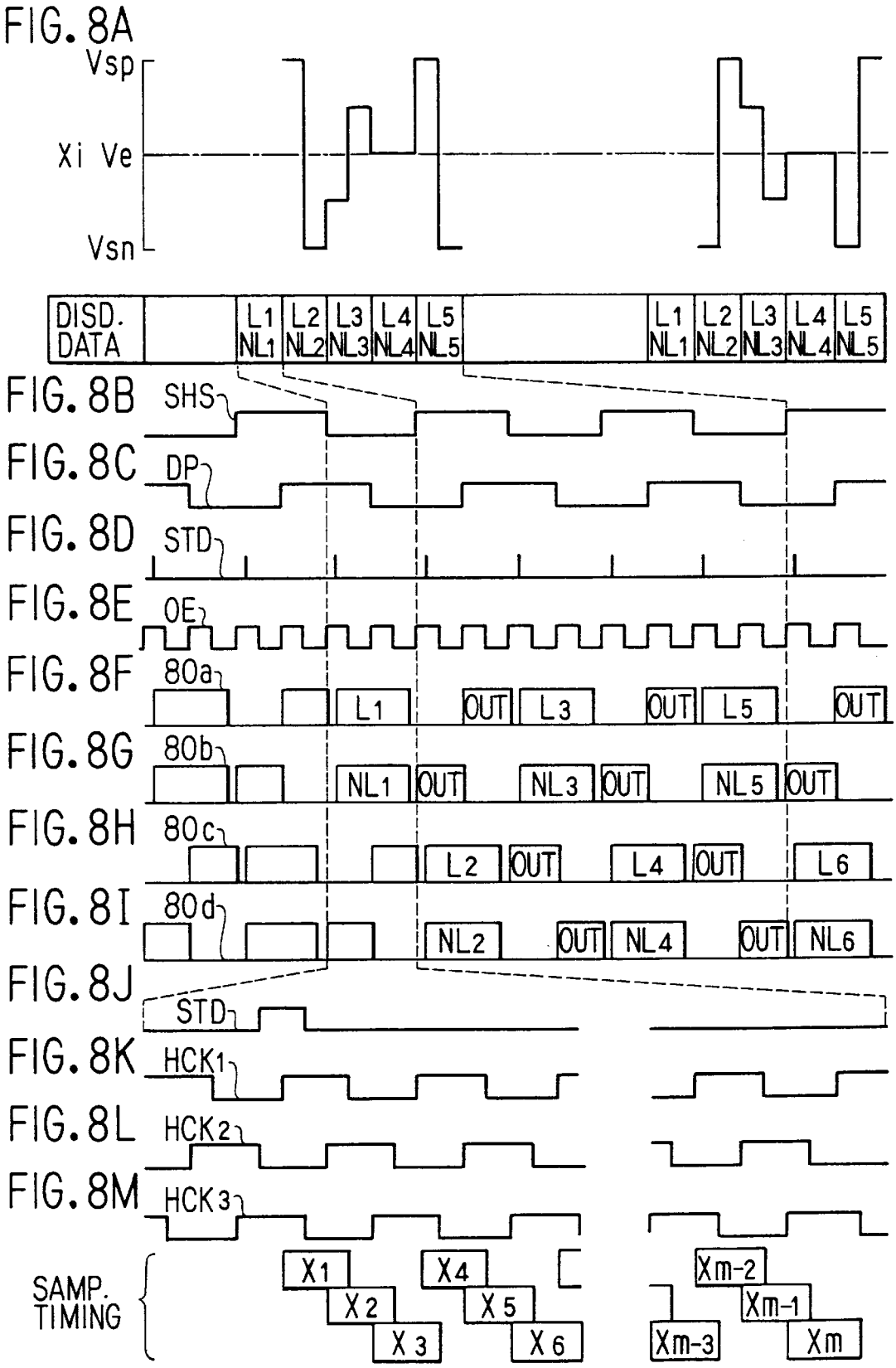

The timing at which signals are sampled is established in the manner described now. As shown in FIGS. 8A, 8J and 8K, the timing at which the image signal voltage to the signal electrode $X_1$ is established during a time interval which starts at the leading edge of the HCK1 signal and persists as long as the STD signal remains at a high level. The timing at which the image signal voltage to the signal electrode $X_2$ is sampled is established during a time interval which starts at the leading edge of the HCK2 signal and persists as long as the HCK1 signal remains at a high level as shown in FIGS. 8K and 8L. The timing at which the image signal voltage to the signal electrode $X_3$ is sampled is established during a time interval which starts at the leading edge of the HCK3 signal and persists as long as the HCK2 signal remains at a high level as shown in FIGS. 8L and 8M. Subsequently, the timing at which the image signal voltages to the signal electrodes $X_4, X_5, \ldots, X_m$ are sampled is similarly established.

Accordingly, the m-bit shift register 61 produces sampling-timing signals (FIGS. 8A–8M) to SK terminals of the analog sampling circuits $Px_1$–$Px_m$, respectively. The sampling-timing signals determine the timing at which image signal voltages are applied to the signal electrodes $X_1$–$X_m$, respectively, according to the STD signal, HCK1 signal, HCK2 signal, and HCK3 signal for each scanning line as shown in FIGS. 8J–8M).

A positive image signal voltage VR and a negative image signal voltage NVR are applied to the analog sampling circuits $Px_1$, $Px_4$, $Px_7$, $P_{xm-2}$, corresponding to the signal electrodes $X_1, X_4, X_7, \ldots X_{m-2}$, respectively, in response to the above-described sampling-timing signals. A positive image signal VG and a negative image signal NVG are applied to the analog sampling circuits $Px_2$, $Px_5$, $Px_8, \ldots, P_{xm-1}$ corresponding to the signal electrodes $X_2, X_5, X_8, \ldots, X_{m-1}$, respectively. Also, a positive image signal voltage VB and a negative image signal voltage NVB are applied to the analog sampling circuits $Px_3$, $Px_6$, $Px_9, \ldots, Px_m$ corresponding to the signal electrodes $X_3, X_6, X_9, \ldots, X_m$, respectively.

Figure 4:
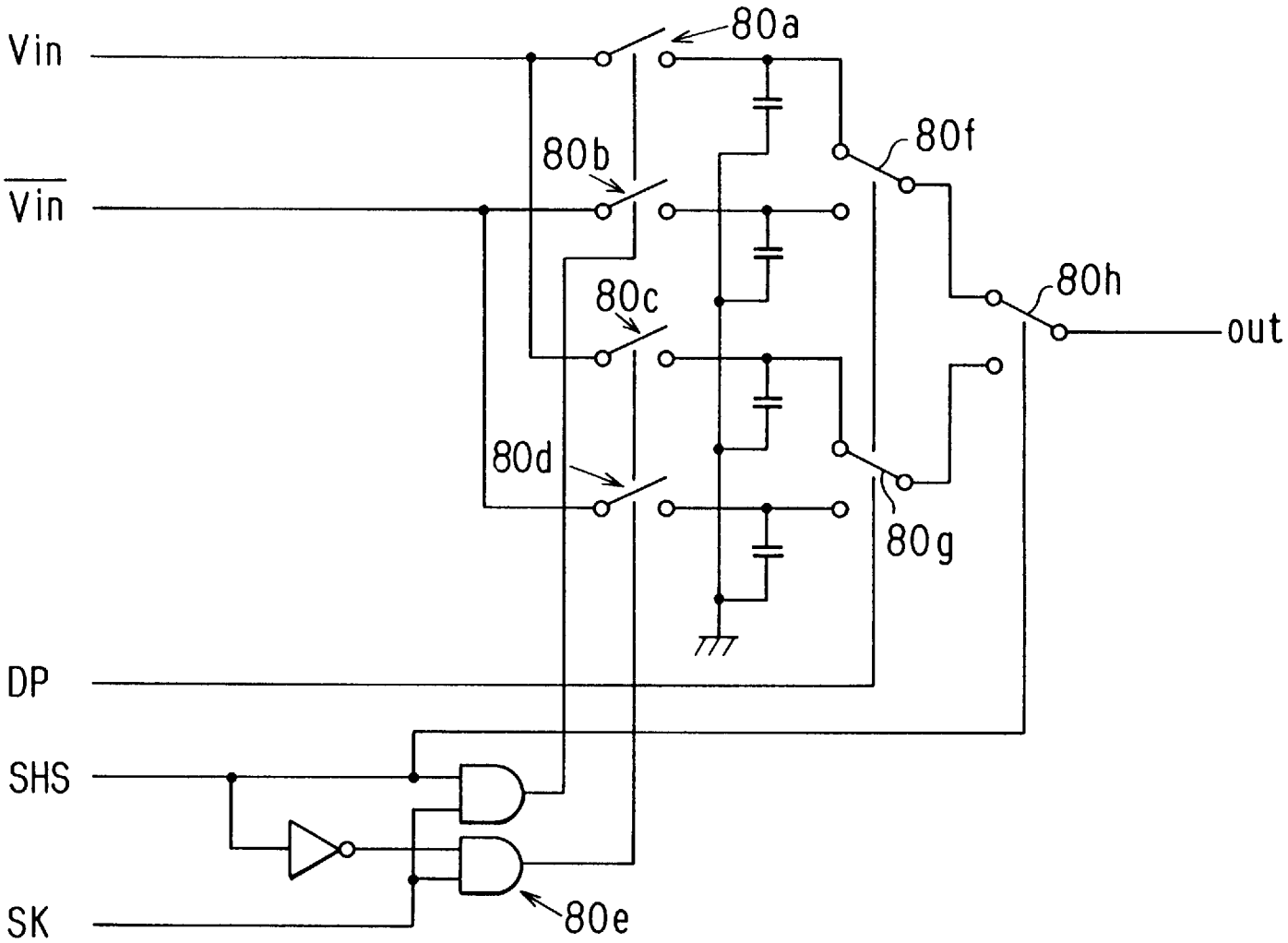
FIG. 4 is a circuit diagram of sample-and-hold circuits included in the signal electrode driver circuit shown in FIG. 3.

Each of the analog sampling circuits $Px_1$–$Px_m$ is equipped with four sample-and-hold circuits 80*a*–80*d* each including an analog switch and a hold capacitor, as shown in FIG. 4. The sample-and-hold circuits 80*a* and 80*c* sample and hold positive image signal voltages, while the sample-and-hold circuits 80*b* and 80*d* sample and hold negative image signal voltages.

The sample-and-hold circuits 80*a* and 80*b* make a set. Also, the sample-and-hold circuits 80*c* and 80*d* make a set. When one of these two sets is in a holding state and producing a holding signal, the other samples the image signal voltage to the next scanning line. In this way, image signal voltages are alternately held and sampled via a switching circuit 80*e* according to an SHS signal (FIG. 8B) which is switched between a high level and a low level for each scanning line.

The switching circuit 80*e* produces an output signal to the set of the sample-and-hold circuits which is in a sampling state according to the above-described sampling-timing signal applied to the SK terminal. The aforementioned DP signal indicating the polarity of one scanning electrode controls both analog switches 80*f* and 80*g*. The sample-and-hold circuits in a holding state produces a held image signal voltage which is either positive or negative.

An analog switch 80*h* is controlled by the SHS signal which addresses scanning lines. Finally, image signal voltages selected by the analog switches 80*f*, 80*g*, and 80*h* are produced. The operation described above is performed for each of the analog sampling circuits $Px_1$–$Px_m$. The aforementioned control signal-generating circuit 43 produces an OE signal. When the OE signal from the control signal-generating circuit 43 goes high, image signal voltages are produced to the signal electrodes $X_1$–$X_m$ at the same time.

In FIGS. 8A–8M, let Lj be image data about all pixels arranged on the j-th scanning electrode, the data being entered by the positive image signal voltages VR, VG, and VB. Let NLj be image data about all pixels arranged on the j-th scanning electrodes the data being entered by the negative image signal voltages NVR, NVG, and NVB. That is, data about all the pixels arranged on the first scanning electrode are indicated by L1 and NL1. The timing at which the sample-and-hold circuits 80*a*–80*d* sample the successive image signal voltages, i.e., data sets about the pixels from the first set of data (i.e., L1 and NL1), and produce output signals are shown.

In this configurations the SCC signal and the DP signal to the scanning electrode driver circuit 50 are synchronized with the SHS signal, DP signal, and OE signal to the signal electrode driver circuit 60. Image data about pixels on selected scanning electrodes are sent as image data signals ANR, ANG, and ANB to the level converter circuit 70 one select period earlier. In this manner, liquid crystal-driving waveforms as shown in FIGS. 6A–6D are accomplished.

Figure 5:
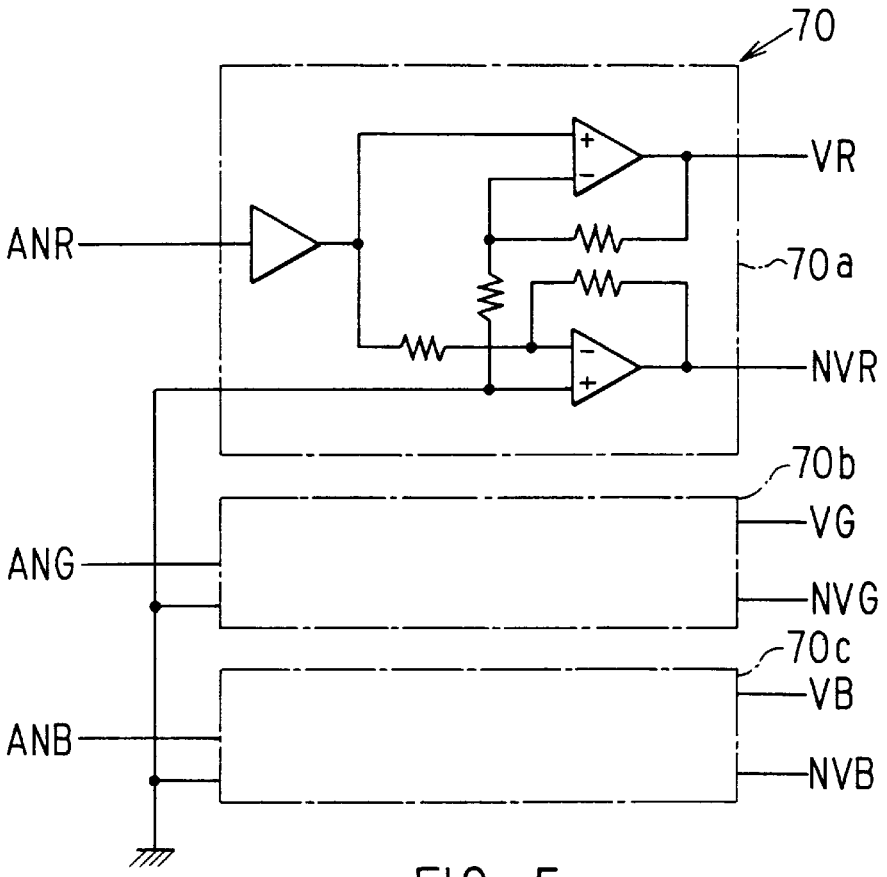
FIG. 5 is a circuit diagram of a level converter circuit shown in FIG. 1.

The image data signals ANR, ANG, and ANB corresponding to R, G, and B, respectively, are applied from the outside. The signals ANR, ANG, and ANB indicating image data about the pixels on the scanning electrodes $Y_1$–$Y_n$ are successively applied to the level converter circuit 70 in the order of the signal electrodes $X_1$–$X_n$ (see FIGS. 1–5). The level converter circuit 70 has level conversion portions 70*a*–70*c* as shown in FIG. 5. The level converter circuit 70 amplifies the image data signals ANR, ANG, and ANB by a factor of A and by a factor of −A by means of the level conversion portions 70*a*–70*c* and produces positive image signal voltages VR, VG, VB and negative image signal voltages NVR, NVG, and NVB (where N indicates opposite polarity) to the signal electrode driver circuit 60.

In the circuit configuration constructed as described thus fare when the temperature sensor 20 detects the temperature of the liquid crystal panel 10, the analog output signal from the sensor 20 is converted into digital form by the A/D converter 30. The signal indicating the temperature in digital form is applied to the CPU 42 of the control unit 40. Then, the CPU 42 determines an optimum de-select period from the digital signal and from the data (see TABLE 1) stored in the memory 41 and sends data about the determined de-select period to the control signal-generating circuit 43.

Then, this control signal-generating circuit 43 creates the scanning electrode driver circuit control signals and the signal electrode driver circuit control signals using the externally applied vertical synchronizing signal VSYC and horizontal synchronizing signal HSYC, and supplies the created signals to the scanning electrode driver circuit 50 and signal electrode driver circuit 60.

It is now assumed that the de-select period is 2H, where H indicates the period of the SCC signal, as shown in FIG. 7. The control signal-generating circuit 43 controls only the SIO1 and SIO2 signals of the scanning electrode driver circuit control signals according to data indicating the optimum de-select period in such a way that the low-level period of the SIO1 and SIO2 signals is twice as long as the period of the SCC signal.

Where the temperature is 40° C., for examples TABLE 1 indicates that the optimum de-select period is 5H. The low-level period of the SIO1 and SIO2 signals is controlled to be five times as long as the period of the SCC signal. In this way, the optimum de-select period is controlled according to the data (TABLE 1) stored in the memory 41 and according to the digitized temperature. The SIO1 and SIO2 signals having a period corresponding to the controlled optimum de-select period are delivered to the scanning electrode driver circuit 50.

As a results the scanning electrode driver circuit 50 drives the scanning electrodes $Y_1$–$Y_n$ of the liquid crystal panel 10 according to the scanning electrode driver circuit control signals from the control signal-generating circuit 43, the driver circuit control signals including the SIO1 and SIO2 signals controlled as described above. This operation is carried out so that the de-select period is equal to the period of the SIO1 and SIO2 signals controlled as described above. The signal electrode driver circuit 60 drives the signal electrodes $X_1$–$X_m$ of the liquid crystal panel 10 according to the image signal voltages from the level converter circuit 70.

Consequently the de-select period is controlled best at all times in spite of variations of the temperature of the liquid crystal panel 10. This can prevent the displayed image from tailing off. Furthermore, at high temperatures, it is assured that the de-select period is set optimally according to the data (TABLE 1) stored in the memory 41. As a consequences decrease of the brightness of the liquid crystal panel 10 in a bright state (corresponding to the brightness of the display created by the activated pixels) which would normally be induced by an excess of the de-select period, i.e., lack of the retention period, can be suppressed most effectively.

In the above embodiments the logic functions are implemented in hardware. Instead, the logic functions may be implemented in software. Furthermore, the processing performed by the CPU 42 may also be realized by hardware logic circuits.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A matrix liquid crystal display comprising:

a liquid crystal panel having n scanning electrodes, m signal electrodes and an antiferroelectric liquid crystal layer all of which together form pixels arranged in rows and columns, the signal electrodes opposing the scanning electrodes via the antiferroelectric liquid crystal layer;

liquid crystal panel driving means for establishing a first driving period of the pixels by applying a first voltage to one of the n scanning electrodes so that all pixels on the one scanning electrode are deactivated during the first period; for establishing a second period by applying a second voltage to the one scanning electrode and to the m signal electrodes so that image data is written to selected pixels on the one scanning electrode during the second period; for establishing a third period by applying a third voltage to the one scanning electrode such that present states of the pixels on the one scanning electrode are maintained during the third period; and for repeating these operations for each of the n scanning electrodes successively to provide a display of an image;

temperature detecting means for detecting a temperature of the liquid crystal panel;

first period control means for controlling the first period according to variations of the temperature signal and for generating a temperature signal representative thereof; and voltage applying means for applying the first voltage to the one scanning electrode to secure the first period controlled by the first period control means;

the liquid crystal layer having a response time that rapidly decreases as the temperature increases over a lower temperature range and that slowly decreases as the temperature increases over a higher temperature range;

the first period being determined so that the first period rapidly decreases as the temperature increases over the lower temperature range and the first period slowly decreases as the temperature increases over the higher temperature range.

2. The matrix liquid crystal display of claim 1, wherein the first period control means controls the first period according to variations of the detected temperature so that an image created by selected ones of the pixels exhibits predetermined brightness levels.

3. The matrix liquid crystal display of claim 1, wherein the first period control means controls the first period so that the first period is an integral multiple of a natural number representative of the second period.

4. The matrix liquid crystal display of claim 3, wherein the first period control means controls the first period according to variations of the detected temperature so that an image created by selected ones of the pixels exhibits predetermined brightness levels.

5. A matrix liquid crystal display comprising:

a liquid crystal panel having n scanning electrodes, m signal electrodes, and an antiferroelectric liquid crystal layer collectively forming pixels arranged in rows and columns, the signal electrodes opposing the scanning electrodes via the antiferroelectric liquid crystal layer;

liquid crystal panel driving means for establishing a first period by applying a first voltage to one of the n scanning electrodes so that all pixels on the one scanning electrode are deactivated during the first period; for establishing a second period by applying a second voltage to the one scanning electrode and to the m signal electrodes so that image data is written to selected pixels on the one scanning electrode during the second period; for establishing a third period by applying a third voltage to the one scanning electrode such that present states of the pixels on the scanning electrodes are maintained during the third period; and for repeating these operations for the n scanning electrodes successively to provide a display of an image;

temperature detecting means for detecting temperature of the liquid crystal panel and for generating a temperature signal indicating the temperature;

an analog-to-digital converter for converting the temperature signal from the temperature detecting means into digital form and for generating a digital output signal representative thereof;

a memory in which data about periods of time corresponding to various temperatures that can be represented by the digital output signal is stored; and a first period control means for determining the first period from the data stored in the memory and sending the determined first period to the liquid crystal panel driver means;

the liquid crystal layer having a response time that rapidly decreases as the temperature increases over a lower temperature range and that slowly decreases as the temperature increases over a higher temperature range;

the first period being determined so that the first period rapidly decreases as the temperature increases over the lower temperature range and the first period slowly decreases as the temperature increases over the higher temperature range.

6. The matrix liquid crystal display of claim 5, wherein the first period control means receives external clock pulses of a given period, the first period control means multiplies the period of the clock pulses by a first factor to create the second period and sends the second period to the liquid crystal panel driver means, and the first period control means multiplies the period of the clock pulses by a second factor to create the first period and sends the first period to the liquid crystal panel driver means, the second factor being an integral multiple of the first factor.

7. A liquid crystal display unit comprising:

a liquid crystal display;

a temperature sensor for detecting a temperature of the display and for generating a temperature signal representative thereof; and driving means, connected to the display and the temperature sensor, for selecting driving characteristics of the display responsive to the temperature signal and for driving the display according to the selected driving characteristics;

the liquid crystal display having a response time that rapidly decreases as the temperature increases over a lower temperature range and that slowly decreases as the temperature increases over a higher temperature range;

the first period being determined so that the first period rapidly decreases as the temperature increases over the lower temperature range and the first period slowly decreases as the temperature increases over the higher temperature range.

8. The liquid crystal display unit of claim 7, wherein:

the display includes a plurality of first electrodes and a plurality of second electrodes and a plurality of pixels disposed at intersections of respective ones of the plurality of first and second electrodes;

the driving means drives the display by applying voltages to the pixels to selectively de-select an illumination state of the pixels during a de-select period, set the illumination state of the pixels during a select period, and maintain the illumination state of the pixels during a maintain period;

the driving characteristics include the de-select period of pixels in the display; and the driving means selects the de-select period responsive to the temperature signal.

9. The liquid crystal display unit of claim 8, wherein the de-select period is selected to be an integral multiple of a clock signal of the display.

10. A method of driving a liquid crystal display, said method comprising the steps of:

detecting a temperature of said liquid crystal display;

applying driving voltages to said display according to driving characteristics of said display; and varying said driving characteristics according to said detected temperature so that a display response time rapidly decreases as the temperature increases over a lower temperature range and slowly decreases as the temperature increases over a higher temperature range, and a first display period rapidly decreases as the temperature increases over the lower temperature range and slowly decreases as the temperature increases over the higher temperature range.

11. The method of claim 10, wherein:

said applying step includes the steps of:

selectively and repetitively applying a de-select voltage to pixels in said display during a de-select time period, selectively and repetitively applying a select voltage to pixels in said display during a select time period, and selectively and repetitively applying a maintain voltage to pixels in said display during a maintain time period; and said varying step includes a step of selecting a length of said de-select time period according to said detected temperature.

12. The method of claim 10, wherein said varying step comprises a step of selecting the driving characteristics so that the display has a minimal response time at the detected temperature.

13. The method of claim 12, wherein the selecting step selects the de-select period to be an integral multiple of a clock signal of the display.

14. The method of claim 10, wherein said varying step comprises a step of selecting the driving characteristics so that the display displays predetermined brightness levels at predetermined locations thereof at the detected temperature.

15. The matrix liquid crystal display of claim 1, wherein the higher temperature range is above a predetermined temperature, and the first period decreases by a first changing ratio over the higher temperature range, and the lower temperature range is below the predetermined temperature, and the first period decreases by a second changing ratio greater than the first changing ratio over the lower temperature range.

16. The matrix liquid crystal display of claim 15, wherein the second changing ratio increases as the temperature decreases at the lower temperature range.

17. The matrix liquid crystal display of claim 16, wherein the first period control means controls the first period according to variations of the detected temperature so that an image created by selected ones of the pixels exhibits predetermined brightness levels.

18. The matrix liquid crystal display of claim 16, wherein the first period control means controls the first period so that the first period is an integral multiple of a natural number representative of the second period.

19. The matrix liquid crystal display of claim 18, wherein the first period control means controls the first period according to variations of the detected temperature so that an image created by selected ones of the pixels exhibits predetermined brightness levels.

* * * * *